US005458607A

United States Patent [19]

Heintke et al.

[11] Patent Number: 5,458,607

[45] Date of Patent: Oct. 17, 1995

[54] PLUCKING HEAD FOR EPILATING APPLIANCES

[75] Inventors: Hans-Eberhard Heintke, Wächtersbach; Gebhard Braun, Kelkheim, both of Germany

[73] Assignee: Braun Aktiengesellschaft, Frankfurt, Germany

[21] Appl. No.: 169,575

[22] Filed: Dec. 14, 1993

[30] Foreign Application Priority Data

Jun. 18, 1991 [DE] Germany ..... 41 20 014.4

[51] Int. Cl.[6] ..... A45D 26/00

[52] U.S. Cl. ..... 606/133; 606/131

[58] Field of Search ..... 606/131, 133; 452/82, 85, 99, 100, 102

[56] References Cited

U.S. PATENT DOCUMENTS 5,234,441 8/1993 Heintke et al. .

5,254,124 10/1993 Heintke et al. ..... 606/133

FOREIGN PATENT DOCUMENTS 0442419 8/1991 European Pat. Off. ..... 606/133

3922949 7/1989 Germany .

*Primary Examiner*—Stephen C. Pellegrino

*Assistant Examiner*—Glenn Dawson

*Attorney, Agent, or Firm*—Fish & Richardson

[57] ABSTRACT

The invention is directed to a plucking head for epilating appliances, with a motor-powered plucking tube provided with gripping members and rotatably mounted in, and partly enclosed by, the casing of the appliance. A rotary cam is aligned coaxially within the tube and is operatively associated with the gripping members, as well as with a step-by-step mechanism movably connected to both the plucking tube and the cam.

8 Claims, 4 Drawing Sheets

PLUCKING HEAD FOR EPILATING APPLIANCES

This invention relates to a plucking head for epilating appliances, with a motor-powered plucking tube provided with gripping members and rotatably mounted in, and partly enclosed by, the casing of the appliance, and with a rotary cam aligned coaxially with the tube and operatively associated with the gripping members.

In a known epilating appliance of this type (DE 39 22 949 C1U.S. Pat. No. 6,234,441), the cam is secured to the free end of a shaft cantilevered in the housing of the appliance and rotated by the motor through a separate gearing, wherein the transmission ratio is selected such that the shaft and thus the cam revolve in a direction identical to, yet at a speed lower than, the plucking tube with its gripping members which is caused to rotate by a further gearing. It is thereby essentially accomplished that the locations on the skin where the plucking action takes place change continuously. As a result of the constant action of the rotary cam on the spring-mounted gripping members, a significant part of the driving power is consumed for the generation of the clamping force.

It is an object of the present invention to configure the plucking head for an epilating appliance of the type initially referred to in such a manner that the amount of energy expended for producing the clamping force is reduced.

According to the present invention, this object is accomplished in an epilating appliance of the type initially referred to by a self-locking step-by-step mechanism movably connected to both the plucking tube and the cam.

This solution of the invention obviates the need for a special gear arrangement for driving the camshaft as provided in the epilating appliance according to the prior art cited additional to the gearing for driving the plucking tube. The energy requirement which plays an important role particularly in small battery-powered electrical appliances is substantially reduced because the clamping force, rather than being required to be produced by the drive for the full duration of rotation, need only be produced by the drive at the stepping stage. Moreover, the technically relatively complex cantilevered support of the camshaft is obviated, together with all its other attendant disadvantages with regard to construction cost and space requirements in the casing of the epilating appliance.

Step-by-step mechanisms may be configured in a variety of ways. In an advantageous embodiment of the present invention, the step-by-step mechanism is configured as a ratchet-and-pawl mechanism comprising a ratchet wheel and at least two pivotally mounted pawls cooperating with the ratchet wheel and urged into engagement therewith under spring action. A substantial advantage of this arrangement of the present invention consists in that such a ratchet-and-pawl mechanism enables the cam displacement to be effected under no-load conditions of the cam, whereby the amount of energy required or consumed for actuating the plucking head is reduced, diminishing the wear of cooperating parts materially. Moreover, such a step-by-step mechanism involves low constructional expenditure, has low space requirements and, accordingly, can be accommodated in the drive path from the motor to the cam with ease.

In a preferred embodiment of the present invention, the plucking head has a system axle located in the casing of the appliance coaxially with its geometrical axis, the cam being rotatably mounted on the axle and the ratchet wheel being secured thereto adjacent to the cam, and the pawls are pivoted to the base of the cam body. This successive arrangement of cam and ratchet wheel on the system axle contributes advantageously to further reducing the dimensions of the plucking head.

In a further feature of the present invention, for controlling the intermittent rotary motion of the cam, an inner curve is provided on the inner surface of the plucking tube at the elevation of the pawls, and each pawl is provided with a back profile extending into the path of the inner curve rotating with the plucking tube. In this manner, the pawls are moved out of engagement with the ratchet wheel on each revolution of the plucking tube and are displaced together with the cam by an angle of rotation determined by the pitch of the ratchet wheel. This type of control is particularly simple, obviating the provision of special components apart from the inner curve. This arrangement, too, contributes essentially to the reduction of the manufacturing cost as an advantage of the present invention, in addition to affording the possibility of large-scale in-house production of all parts with the customary manufacturing and assembly requirements at low overall cost, which ensures high dependability in service, reliability and computability of the displacement of the plucking location, and this at minimum additional energy demands for driving the plucking head.

An embodiment of the present invention will be described in the following with reference to the accompanying drawings, in which.

Figure 1:
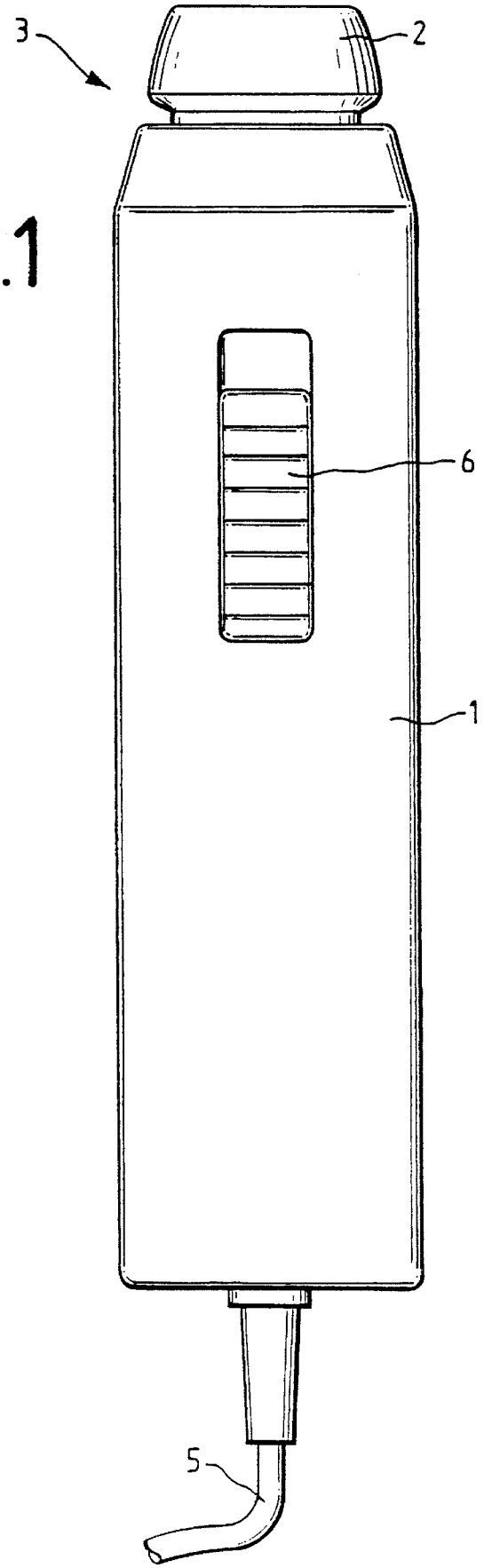
FIG. 1 is an elevation view of an epilating appliance.

Referring now to FIG. 1 of the drawings, there is shown an epilating appliance comprising essentially a casing 1 configured as a handle for guiding the appliance, having protruding from its upper end the crown 2 of a plucking head 3 which is thus partially enclosed by the casing 1. The casing 1 further accommodates a motor 4 in the manner described in the following (FIG. 2), which may be a spring motor or an electric motor powered by primary or secondary cells or directly by the mains supply, as indicated by a cord 5 extending from the opposite end of the casing 1. A switch 6 serves to turn the epilating appliance on and off. Within the casing 1, there is secured a mounting plate 7 carrying the motor 4 on one side while being provided with an elbow structure 8 on its other side to which a system axle 11 is secured in an extension of the motor shaft 9 and the geometrical axis 10 of the plucking head 3. The motor shaft 9 carries a pinion 12 which is in meshing engagement with a gear 13 rotatably mounted on an axle 14 received in the elbow structure 8 of the mounting plate 7 and extending parallel to the system axle 11.

Figure 2:
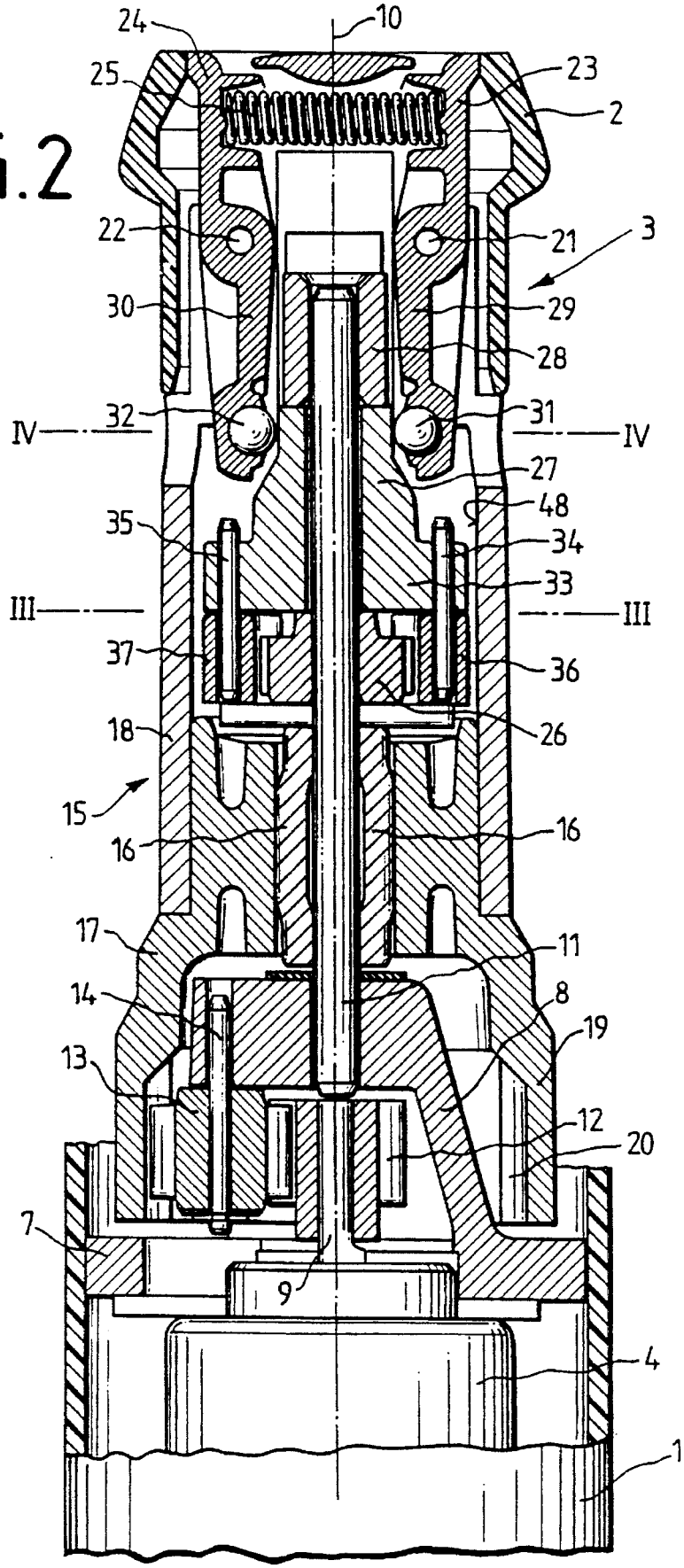
FIG. 2 is a longitudinal section taken through the center of the plucking head, showing the units essential for the function of the epilating appliance.

Rotatably mounted on the system axle 11 by means of a bearing sleeve 16 is a plucking tube 15 forming part of the plucking head 3; the plucking tube 15 may be integrally formed or, as becomes apparent from FIG. 2, it may be composed of three parts for greater ease of manufacture and assembly, including a partially bell-shaped lower portion 17, a cylindrical center portion 18, and an upper portion in the form of the crown 2 referred to in the foregoing, which crown may be of different configurations depending on the application, thus being suitably of the push-on and interchangeable type.

The lower portion 17 of the plucking tube 15 carries a bearing sleeve 16 and has on the inner surface of the bell-shaped area 19 internal teeth 20 for engagement with the gear 13 meshing with the motor pinion 12, thereby establishing the driving relationship between the motor shaft 9 and the plucking tube 15. The center portion 18 of the plucking tube 15 which embraces the lower portion 17 thereof at the elevation of the bearing sleeve 16 (FIG. 2) carries at its free end two gripping members 23 and 24 pivotal about respective axes 21 and 22, the gripping members cooperating with the inner edge of the crown 2 in a known manner therefore not explained in greater detail, being urged into the closed position by a compression spring 25 inserted between the two gripping members 23 and 24, as becomes apparent from FIG. 2. A wheel with special teeth, referred to as a ratchet wheel 26 in the following, is rigidly secured to the system axle 11 by being press-fitted thereto. Above this ratchet wheel 26 (FIG. 2), a cam 27 forming a further part of the plucking head 3 is rotatably mounted on the system axle 11 and secured against axial displacement by means of a collet 28. Beyond their respective pivot axes 21 and 22, the gripping members are provided with downwardly extending lever arms 29 and 30, respectively (FIG. 2) which, under the action of the spring 25, partly engage the cam 27 by means of respective balls 31 and 32 press-fitted to the lever arms for the purpose of reducing friction (FIG. 4). Inserted into an enlarged base 33 of the cam 27 on either side and parallel to the system axle 11 are two diametrically opposed axles 34 and 35 on which two respective pawls 36 and 37 in the form of a two-armed lever are pivotally mounted, as will be seen in FIG. 3. At the one lever end 38 and 39 of the pawls 36 and 37, a respective tooth 40 and 41 is provided which cooperates with the teeth 42 of the ratchet wheel 26. An expanding spring 43 common to both pawls 36 and 37 has its free ends 44 and 45 in engagement with the other lever arms 46 and 47, respectively, of the pawls 36 and 37, urging these into meshing engagement with the teeth 42 of the ratchet wheel 26. Provided on the inner surface 48 of the cylindrical center portion 18 of the plucking tube 15 is an inner curve 49 which cooperates with suitably conformed back profiles 50 and 51, that is, profiles extending into the curve path 53, on the respective lever arms 46 and 47 of the respective pawls 36 and 37, in the sense of moving the pawls 36 and 37 out of engagement with the teeth 42 of the ratchet wheel 26, in opposition to the action of the expanding spring 43.

The ratchet wheel 26 and the two pivotal pawls 36 and 37 combine to form a step-by-step ratchet-and-pawl mechanism which, controlled by the inner curve 49, translates the continuous rotary movements of the plucking tube 15 of the plucking head 3 into an intermittent rotary movement of the cam 27 in the manner subsequently described (see FIGS. 3 to 5, the latter Figure being explained in detail): The plucking tube 15, driven by the motor 4 via the pinion 12 and the gear 13, rotates in the direction of the arrow A. In the initial position shown in FIG. 3, the tooth 40 of the upper pawl 36 is in locking engagement with the teeth 42 of the ratchet wheel 26, preventing the cam 27 from moving in either direction of rotation. The construction and arrangement of the pawls 36 and 37 shown in FIG. 3 causes the pawls to be self-locking in either direction of rotation. The holding function thus requires a minimum force from the expanding spring 43 and practically no friction due to the self-locking action between the pawls and the ratchet wheel. The lower pawl 37 rests with its tooth 41 on the tip 52 of the associated tooth of the ratchet-wheel teeth 42, being thus in a pre-locking position. The cam 27 is in the position shown in FIG. 4, and the balls 31, 32 of the gripping members 23, 24 are in abutment with the outside radius $R_a$, causing the gripping members 23, 24 to be urged into the open position.

As the rotary motion of the plucking head 3 proceeds in the direction indicated by the arrow A, the inner curve 49 provided on the inner surface 48 of the center portion of the plucking tube 15 will contact the back profile 50 of the upper pawl 36. By suitably matching the position of the cam 27 with the ratchet-and-pawl mechanism (26, 36, 37), it is ensured that at this instant the opening phase of the gripping members 23, 24 is terminated, its balls 31, 32 then rolling on the inside radius $R_i$ of the cam 27 with an air gap therebetween, as indicated in FIG. 4 by the ball contours drawn in dashed lines. In this phase in which no rotatory force acts on the cam 27 and the upper pawl 36, the latter is disengaged from the ratchet wheel 26, and the friction between the inner curve 49 and the pawl 36 causes it to start rotating together with the cam 27 in the direction of the arrow A; then the ascending curve of the cam 27, that is, the transition from the inside radius $R_i$ to the outside radius $R_a$ will take effect, whereby the residual angular momentum, if any, causes the lower pawl 37 to fall into locking engagement with the teeth 42 of the ratchet wheel 26. This lower pawl 37 will then take over the locking function for holding the cam 27 in a fixed position during the stages in which the gripping members open, are maintained open and close again, whilst the upper pawl 36 will move to the pre-locking position following release by the inner curve. When the inner curve 49 reaches the lower pawl 37 as the rotary motion of the center portion 18 of the plucking tube 15 proceeds, the cyclic action described above for the upper pawl 36 will commence for the lower pawl correspondingly.

Figure 3:
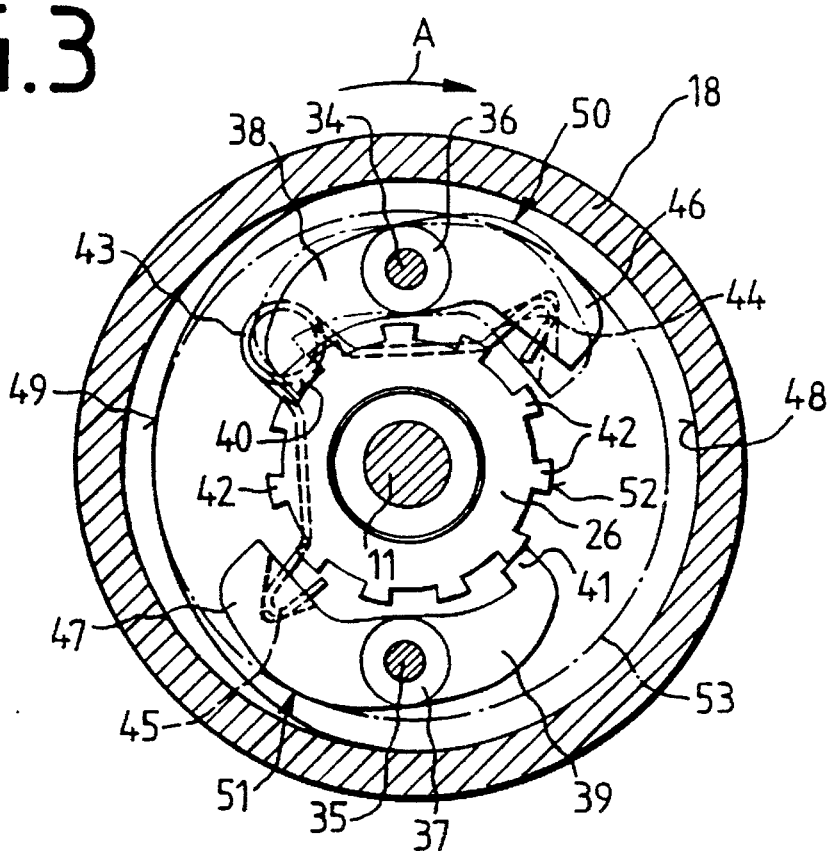
FIG. 3 is a view taken along the line III—III of FIG. 1, showing a simplified representation.
Figure 4:
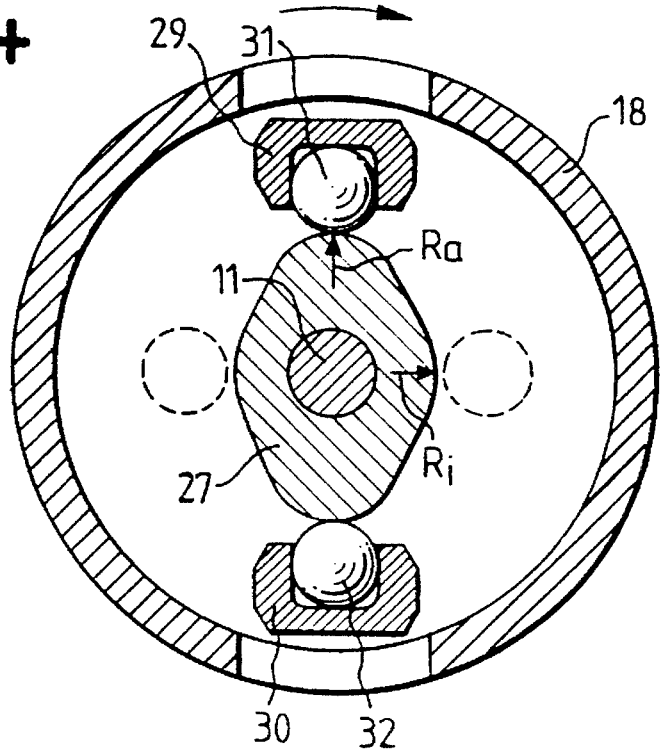
FIG. 4 is a view taken along the line IV—IV of FIG. 1, showing a fragmentary, simplified representation.
Figure 5:
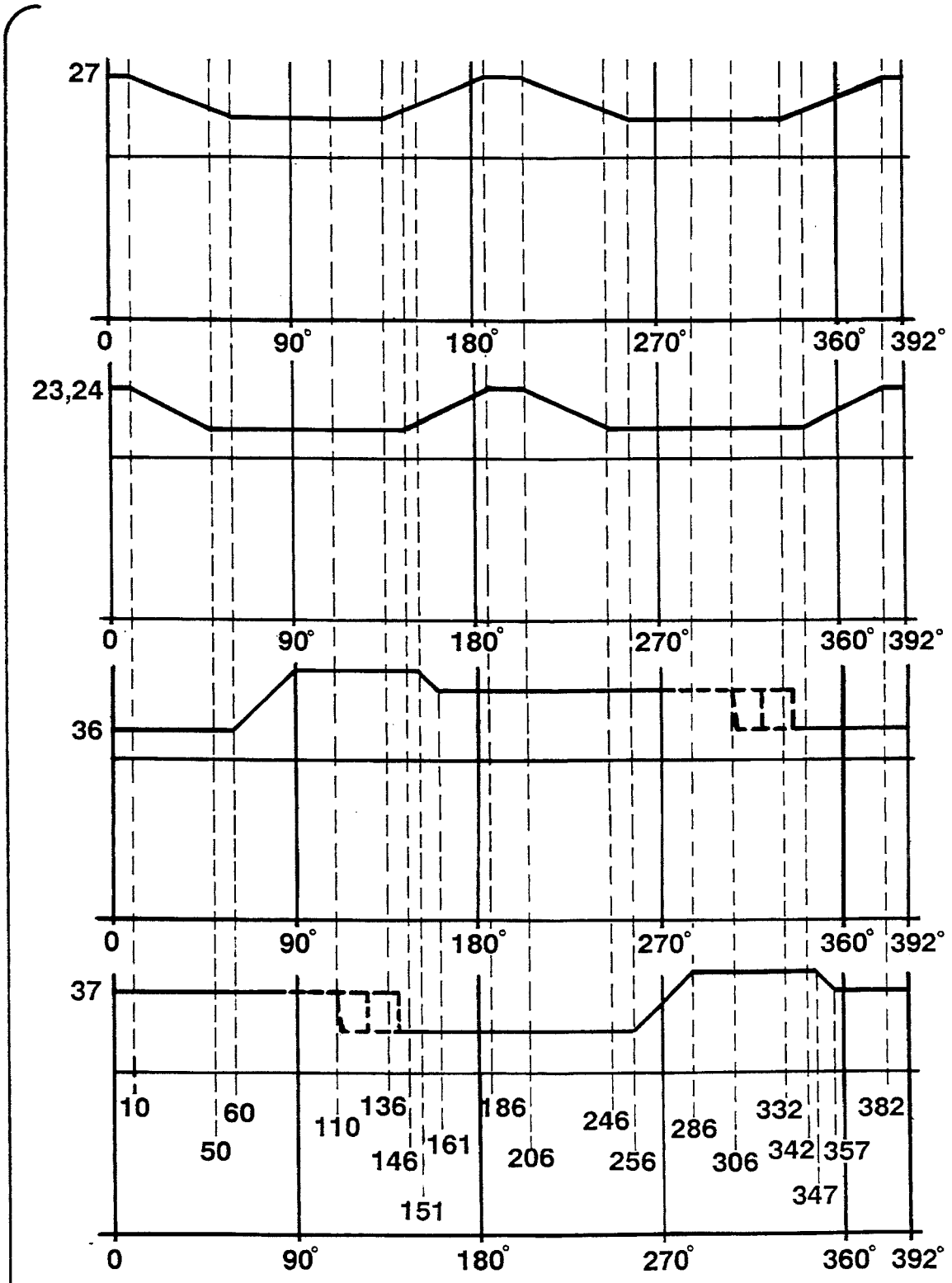
FIG. 5 is a diagram.

In the following, the cycle of movements of the components indicated above will be described again in more detail, in relation to the respective angular positions on rotation of the plucking head, reference being had to the diagram of FIG. 5. The cycle of action is as follows:

0° initial position of all components as illustrated in FIG. 3;

10° cam 27: transition curve towards inside radius $R_i$ begins; gripping members 23, 24: closing movement begins;

50° gripping members 23, 24: closing movement completed—plucking gap closed;

60° cam 27: transition curve completed, $R_i$ begins; upper pawl 36: disengaging movement begins;

90° upper pawl 36: disengaging movement completed, system free to rotate;

110° angular range for locking engagement of lower pawl—37 by rotation;

140°

136° cam 27: ascending transition curve begins;

146° gripping members 23, 24: opening movement begins;

151° upper pawl 36 moves from fully disengaged position into

161° pre-locking position (pawl 36 resting on tip 52 of ratchet-wheel tooth);

186° cam 27: outside radius $R_a$ of cam curve begins; gripping members 23, 24: fully opened position reached;

206° as at 10° above. The cyclic action is repeated on cam 27, yet in a 180° offset relation (cam 27 having been turned through about 16°);

246° as at 50° above;

256° as at 60° above, transition curve completed, inside radius $R_i$ begins, at the same time the lower pawl 37 begins its disengaging movement;

286° lower pawl 37: disengaging movement completed;

306° angular range for locking engagement of upper pawl 36;

336° (see 110°–140° range);

332° as at 136° above;

342° as at 146° above;

347° lower pawl 37 moves from fully disengaged position into

357° pre-locking position (see 151°–161° range);

382° as at 186° above;

392° new initial position for next revolution of cam-and-pawl mechanism. In this new initial position, the plucking location is displaced relative to the 0° initial position by the pitch of the ratchet wheel, that is, by 32°. In consequence, after 11 revolutions, all components are again in the same relationships to each other and in the initial position 0°, as illustrated in FIG. 3.

The illustration of FIG. 3 is based on a ratchet wheel having, for example, 11 teeth. It will be understood, however, that any other number of teeth may be selected. The pitch is thus approximately 360 : 11= 32.73°. The displacement of the cam-and-pawl mechanism during the alternating locking action of the pawls is thus half a pitch, that is 32.73°/2. This is the angle of displacement of the plucking assembly between consecutive plucking actions.

We claim:

1. A plucking head for an epilating appliance having casing structure and, a motor in said casing structure, said plucking head comprising plucking tube structure configured to be rotatably mounted on said casing structure, said plucking tube structure including gripping member structure mounted for rotation with said plucking tube structure, drive structure configured to interconnect said motor to said plucking tube structure for driving said plucking tube structure in rotation, rotary cam structure for actuating said gripping member structure aligned coaxially with said plucking tube structure and a interconnected with said gripping member structure, and self-locking step-by-step mechanism movably connected to both Said plucking tube structure and said cam structure for reducing the amount of energy expended for producing a gripping force by said gripping member structure.

2. The plucking head of claim 1 wherein said step-by-step mechanism is configured as a ratchet and pawl mechanism comprising a ratchet wheel and at least two pivotally mounted pawls cooperating with said ratchet wheel and biasing structure for urging said pawls into engagement with said ratchet wheel.

3. The plucking head of claim 2 wherein said plucking head structure has a system axle coaxially located in said casing structure, said cam structure is rotatably mounted on said axle, said ratchet wheel is secured to said axle adjacent said cam structure, said cam structure includes a base portion, and said pawls are pivotally mounted on said base portion of said cam structure.

4. The plucking head of claim 3 wherein said plucking tube structure has an inner surface, and further including inner curve structure on said inner surface of said plucking tube structure adjacent said pawls, said inner curve structure being adapted to rotate with said plucking tube structure, and each said pawl includes a back profile portion extending into the path of said inner curve structure.

5. The plucking head of claim 1 wherein said plucking head structure has a system axle coaxially located in said casing structure and a crown portion, said cam structure is rotatably mounted on said axle, said gripping member structure includes a plurality of gripping elements, each said gripping element being pivotally mounted on said plucking tube structure, and further including biasing structure for urging said gripping elements into engagement with said crown portion.

6. The plucking head of claim 5 wherein said step-by-step mechanism is configured as a ratchet and pawl mechanism comprising a ratchet wheel and at least two pivotally mounted pawls cooperating with said ratchet wheel, and spring structure for urging said pawls into engagement with said ratchet wheel.

7. The plucking head of claim 6 wherein said plucking tube structure has an inner surface, and further including inner curve structure on said inner surface of said plucking tube structure adjacent said pawls, said inner curve structure being adapted to rotate with said plucking tube structure, and each said pawl includes a back profile portion extending into the path of said inner curve structure.

8. The plucking head of claim 7 wherein said plucking head structure has a system axle coaxially located in said casing structure, said cam structure is rotatably mounted on said axle, said ratchet wheel is secured to said axle adjacent said cam structure, said cam structure includes a base portion, and said pawls are pivotally mounted on said base portion of said cam structure.

* * * * *

UNITED STATES PATENT AND TRADEMARK OFFICE

CERTIFICATE OF CORRECTION

PATENT NO. : 5,458,607

DATED : October 17, 1995

INVENTOR(S) : Heintke, et al.

It is certified that error appears in the above-indentified patent and that said Letters Patent is hereby corrected as shown below:

Col. 1, lines 10-11, delete "DE 39 22 949 C1";

Col. 1, line 11, replace "6,234,441" with --5,234,441--;

Col. 5, claim 1, line 32, replace "and," with --and--;

Col. 5, lines 39-40, delete "for actuating said gripping member structure";

Col. 5, line 41, delete "a";

Col. 5, line 42, after "structure" insert --for actuating said gripping member structure--

Col. 5, line 42, after "and" insert --a--;

Col. 5, line 43, replace "Said" with --said--;

Signed and Sealed this

Sixth Day of August, 1996

*Attest:*

*Attesting Officer*

BRUCE LEHMAN

*Commissioner of Patents and Trademarks*